United States Patent [19]

Goloff et al.

[11] 4,005,950

[45] Feb. 1, 1977

[54] BEARINGS FOR SLANT AXIS ROTARY MECHANISMS

[75] Inventors: Alexander Goloff, East Peoria; Roger O. Bjerk, Edelstein, both of Ill.

[73] Assignee: Caterpillar Tractor Co., Peoria, Ill.

[22] Filed: Nov. 5, 1975

[21] Appl. No.: 629,198

[52] U.S. Cl. ..... 418/53; 418/182

[51] Int. Cl.[2] ..... F01C 1/02; F01C 17/00; F03C 3/00; F04C 17/02

[58] Field of Search ..... 418/49–53, 418/68, 182; 73/258

[56] References Cited

UNITED STATES PATENTS

| | | | |
|---|---|---|---|
| 410,308 | 9/1889 | Bowns | 418/53 |
| 3,485,218 | 12/1969 | Clarke | 418/53 |
| 3,492,974 | 2/1970 | Kreimeyer | 418/53 |
| 3,942,384 | 3/1976 | Parker | 418/53 |

*Primary Examiner*—John J. Vrablik
*Attorney, Agent, or Firm*—Wegner, Stellman, McCord, Wiles & Wood

[57] ABSTRACT

An improved slant axis rotary mechanism including a housing defining a chamber having an operating cavity. A shaft is journalled in the housing and includes an angularly offset portion within the chamber. The angularly offset portion has a peripheral, generally radially outwardly extending thrust collar. A rotor is disposed in the chamber and surrounds the angularly offset portion. Thrust bearings sandwich the thrust collar and engage the rotor and a journal bearing is disposed on the radially outer portion of the thrust collar and journals the rotor on the shaft. The journal bearing is functionally uncoupled from the thrust bearing.

3 Claims, 2 Drawing Figures

BEARINGS FOR SLANT AXIS ROTARY MECHANISMS

BACKGROUND OF THE INVENTION

This invention relates to slant axis rotary mechanisms for use as engines, pumps, compressors, or the like. More specifically, it relates to improved bearing systems for such mechanisms.

In slant axis rotary mechanisms, such as a slant axis rotary diesel engine, bearing loads tend to be quite high due to the high pressures involved. Consequently, bearing design has posed a difficult problem. In such mechanisms, there will be high loading of both the journal and thrust bearings by which the rotor is journalled on the main shaft. The clearances at the rotor journal bearings are by necessity close in order to carry the loads imposed generally transversely of the shaft axis, as a large clearance bearing does not have the capability of carrying as large a load as a low clearance bearing. Similarly, the thrust bearing pads on the shaft's thrust collar have rather small end-to-end clearances to maintain a large load carrying capacity and to avoid edge loading.

The rotor of a slant axis rotary mechanism is subjected to couples (turning moments) within a plane passing through the axis of the main shaft. Consequently, both thrust and journal bearings carry the load by resisting the couples. As a result of such couples, one or the other of the journal bearings employed in prior art constructions frequently is overloaded if the couples are to be carried primarily by the thrust collar. Conversely, if the couples are to be carried principally by the journal bearings, deflections occur which reduce the ability of the thrust bearings to carry thrust loads.

In either instance, the bearings buck one another, causing the difficulty.

SUMMARY OF THE INVENTION

It is the principal object of the invention to provide a new and improved slant axis rotary mechanism. More specifically, it is an object of the invention to provide such a mechanism with an improved bearing system.

An exemplary embodiment of the invention achieves the foregoing object in a slant axis rotary mechanism including a housing defining a chamber having an operating cavity. A shaft is journalled in the housing and includes an angularly offset portion within the chamber. A rotor is within the chamber and surrounds the angularly offset portion of the shaft and thrust bearings are interposed between the angularly offset portion and the rotor. A self-aligning journal bearing is disposed between the shaft and the rotor so that the bearings are functionally uncoupled due to the self-aligning characterstics of the journal bearing.

In a preferred embodiment of the invention, the angularly offset portion of the shaft is provided with a radially outwardly extending, peripheral thrust collar which is sandwiched by the thrust bearings. The journal bearing is disposed on the radially outer portion of the thrust collar. Preferably, the same has a relatively low length to diameter ratio.

In a highly preferred embodiment, the journal bearing has spherical outer surface.

Other objects and advantages will become apparent from the following specification taken in connection with the accompanying drawings.

DESCRIPTION OF THE PRIOR ART

Figure 1:
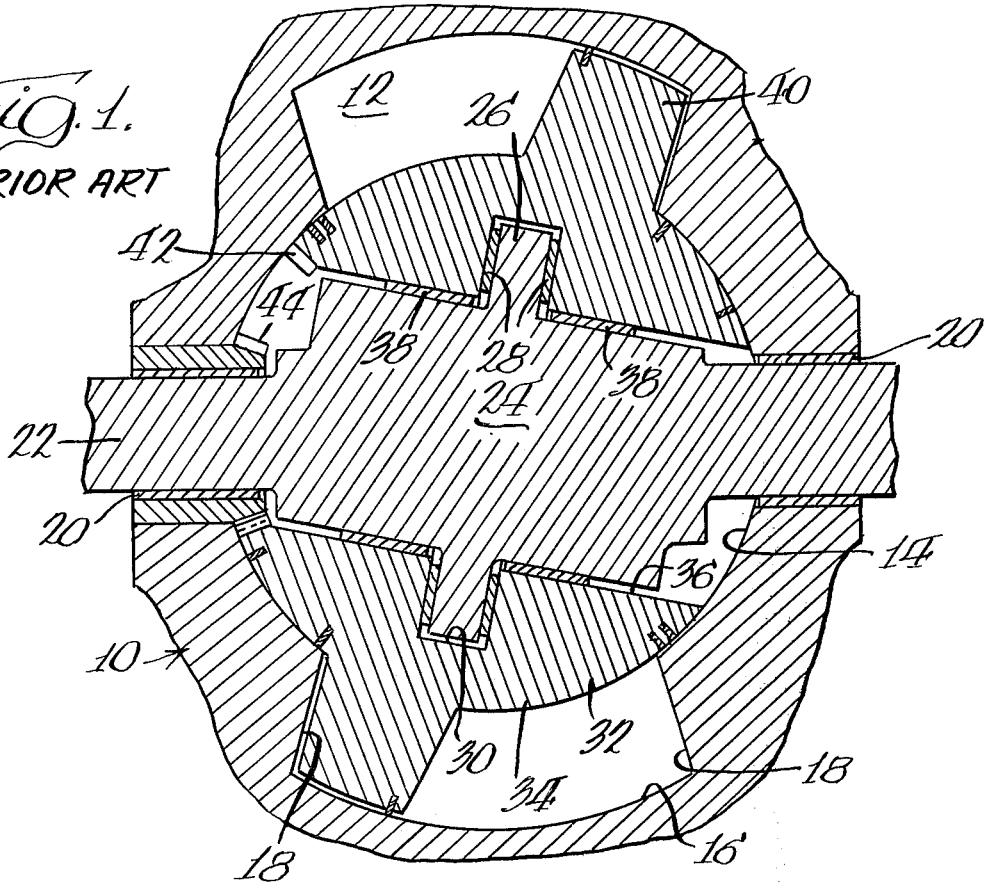
Fig. 1. PRIOR ART
FIG. 1 is a sectional view of a slant axis rotary mechanism made according to the teachings of the prior art.

A typical slant axis rotary mechanism made according to the prior art is illustrated in FIG. 1 in the form of a four-cycle engine. The same includes a housing, generally designated 10, defining a chamber 12, a portion of which acts as an operating cavity, as is well-known. The chamber 12 is defined by a radially inner spherical wall 14, a radially outer spherical wall 16 and opposed, generally radially extending side walls 18 interconnecting the spherical walls 14 and 16.

Bearings 20 journal a shaft 22 for rotation in the housing 10 such that an angularly offset portion 24 or eccentric is disposed within the chamber 12. The angularly offset portion 24 includes a radially outwardly extending peripheral thrust collar 26 which is flanked by radially extending thrust bearings 28. The thrust collar 26 and thrust bearings 28 are received in a radially inwardly opening groove 30 in the hub 32 of a rotor 34. The groove 30 opens inwardly to a central bore 36 in the hub 32.

Generally cylindrical journal bearings 38 are also interposed between the angularly offset portion 24 and the rotor hub 32. The bearings 38 are disposed on both sides of the thrust collar 26 and may be in the position illustrated or, in some instances, may be spaced from the thrust collar 26 to be located at approximately the edges of the angularly offset portion 24.

The rotor 34 includes a peripheral flange 40 designed according to conventional techniques. A variety of seals, not numbered, are carried both by the flange 40 and the hub 32 for sealing the various operating areas during operation of the mechanism.

Finally, the hub 32 is provided with an internal ring gear 42 which is meshed with a timing gear 44 carried by the housing 10 to establish the desired relative rates of rotation of the rotor and the shaft.

From the foregoing, it will be appreciated that forces acting against the rotor will have both vertical and horizontal components. Analysis will indicate that a horizontal force component will tend to cause the rotor to cock on the angularly offset portion 24 with the consequence that the vertical component of the force will be carried by but one of the bearings 38 thereby overloading the same or requiring the use of an oversized bearing.

DESCRIPTION OF THE PREFERRED EMBODIMENT

Figure 2:
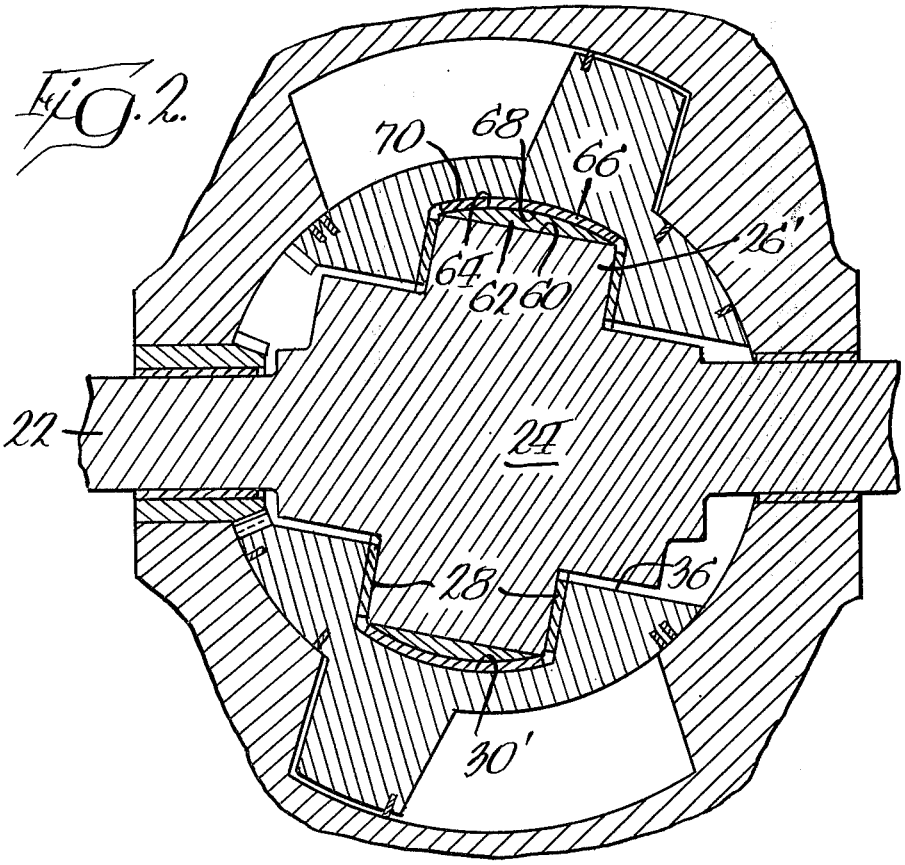
FIG. 2 is a sectional view of a slant axis rotary mechanism made according to the invention.

An exemplary embodiment of a slant axis rotary mechanism made according to the invention is illustrated in FIG. 2 in the form of a four-cycle rotary engine. However, it is to be expressly understood that the invention will find utility in slant axis rotary mechanisms other than engines, such as pumps, compressors or the like and that it may be employed in such mechanisms designed for operation on other than the four-cycle principle.

With the exception of the bearing system, a slant axis rotary mechanism made according to the invention is identical to the prior art. Accordingly, identical components of the invention described above will be given like reference numerals and will not be described further in the interest of brevity.

As can be seen in FIG. 2, the thrust collar 26' on the angularly offset portion 24 of the shaft 22 in a slant axis rotary mechanism made according to the invention is preferably considerably wider than the thrust collar 26 employed in the prior art. It is flanked by thrust bearings 28 which may be identical to those employed in the prior art. On its radially outer periphery 60, it is provided with a peripheral domed element 62 having an outer spherical surface 64. The spherical surface 64 has its center at the center of the thrust collar 26' and thus on the rotational axis of the shaft 22 as seen in FIG. 2. A bearing element 66 having a radially inner spherical surface 68 matingly received on the surface 64 and a radially outer spherical surface 70 received in a spherical groove 30' corresponding approximately to the groove 30 serves as a journal bearing for the rotor 34. More specifically, a self-aligning journal bearing is formed with the consequence that horizontal components of forces acting against the rotor are not placed against the journal bearing by reason of the presence of couples or the like. Rather, such components are totally placed upon the thrust bearings 28. As a consequence, bucking between bearings is eliminated. Such occurs because horizontal components of forces resulting in couples applied to the rotor are not resisted by the journal bearing due to its domed configuration and the location of the center of the surface 64 on the rotational axis of the shaft 22.

Depending upon the intended use, the journal bearing of the invention may slide on the radially outer surface of the thrust collar 26'. Alternately, it may be keyed thereto. In any event, it is preferable that some axial shifting of the journal bearing on the angularly offset portion 24 be permitted to insure complete decoupling of the journal bearings from the thrust bearings. If desired, the bearing components may turn at some rate of rotation intermediate the relative rates of rotation of the rotor and the shaft. In this connection, a suitable bearing surface may be formed on the surface 60 of the thrust collar and the bearing element 66 formed on the rotor 34. The domed element 62 would then serve as a floating bearing element.

While the embodiment illustrated in FIG. 2 illustrates a thrust collar 26' having a substantial increase in width over that of the prior art, the invention contemplates widths on the order of that employed in the prior art. In such a case, the journal bearing need not be truly spherical. Such a journal bearing will have a relatively low length (measured in the axial direction) to diameter ratio as compared to prior art structures by reason of being disposed in the radially outer periphery of the thrust collar, thereby resulting in an increased diameter and a lowered length to diameter ratio. Such a bearing will tend to be self-aligning even though not spherical, with the consequence that the journal bearing will be functionally uncoupled from the thrust bearings and the objects of the invention achieved. In general, a "relatively low" length to diameter ratio will be one or less.

What is claimed is:

1. A slant axis rotary mechanism comprising:

a housing defining a chamber including an operating cavity;

a shaft journalled in said housing and including an angularly offset portion within said chamber, said angularly offset portion including a peripheral, generally radially outwardly extending thrust collar;

a rotor in said chamber and surrounding said angularly offset portion;

thrust bearings sandwiching said thrust collar and engaging said rotor; and a journal bearing disposed on the radially outer portion of said thrust collar and journalling said rotor on said shaft, said journal bearing having a cross section with a spherical outer surface extending about the entire periphery of said radially outer portion of said thrust collar.

2. The slant axis rotary mechanism of claim 1 wherein said journal bearing has a relatively low length to diameter ratio.

3. A slant axis rotary mechanism comprising: a housing defining a chamber including an operating cavity; a shaft journalled in said housing and including an angularly offset portion within said chamber; a rotor in said chamber and surrounding said angularly offset portion; thrust bearings interposed between said angularly offset portion and said rotor; and means defining a self-aligning journal bearing having a cross section with a domed outer surface extending about the entire periphery of the angularly offset portion and interposed between said angularly offset portion and said rotor, the center of said bearing surface being on the rotational axis of said shaft, whereby said thrust bearings and said journal bearing means are functionally uncoupled.

* * * * *